US012203148B2

(12) United States Patent
Ito et al.

(10) Patent No.: US 12,203,148 B2
(45) Date of Patent: Jan. 21, 2025

(54) HOT-ROLLED STEEL SHEET

(71) Applicant: NIPPON STEEL CORPORATION, Tokyo (JP)

(72) Inventors: Daisuke Ito, Tokyo (JP); Shohei Yabu, Tokyo (JP); Takeshi Toyoda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 462 days.

(21) Appl. No.: 17/767,229

(22) PCT Filed: Dec. 8, 2020

(86) PCT No.: PCT/JP2020/045641
§ 371 (c)(1),
(2) Date: Apr. 7, 2022

(87) PCT Pub. No.: WO2021/117711
PCT Pub. Date: Jun. 17, 2021

(65) Prior Publication Data

US 2022/0372588 A1 Nov. 24, 2022

(30) Foreign Application Priority Data

Dec. 9, 2019 (JP) ..... 2019-222161

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/32*** | (2006.01) |

(52) U.S. Cl.
CPC ..... *C21D 8/0226* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/28* (2013.01); *C22C 38/32* (2013.01); *C21D 2211/001* (2013.01); *C21D 2211/002* (2013.01); *C21D 2211/008* (2013.01)

(58) Field of Classification Search
CPC .. C21D 8/0226; C21D 9/46; C21D 2211/001; C21D 2211/002; C21D 2211/008; C21D 8/0205; C22C 38/001; C22C 38/002; C22C 38/02; C22C 38/04; C22C 38/06; C22C 38/28; C22C 38/32; C22C 38/005; C22C 38/20; C22C 38/22; C22C 38/24; C22C 38/26; C22C 38/38; C22C 38/40; C22C 38/60; C22C 38/42; C22C 38/44; C22C 38/46; C22C 38/48; C22C 38/50; C22C 38/54; C22C 38/58
See application file for complete search history.

(56) References Cited

U.S. PATENT DOCUMENTS

| | | | |
|---|---|---|---|
| 2016/0068937 | A1 | 3/2016 | Nakajima et al. |
| 2016/0076124 | A1 | 3/2016 | Yamazaki et al. |
| 2017/0009316 | A1 | 1/2017 | Yamazake et al. |
| 2018/0237874 | A1 | 8/2018 | Yamazaki et al. |
| 2020/0063227 | A1 | 2/2020 | Yamazaki et al. |

FOREIGN PATENT DOCUMENTS

| | | | |
|---|---|---|---|
| JP | 2007-70660 | A | 3/2007 |
| JP | 2014-205888 | A | 10/2014 |
| WO | WO 2014/171063 | A1 | 10/2014 |
| WO | WO2015/129199 | A1 | 9/2015 |
| WO | WO2017/017933 | A1 | 2/2017 |
| WO | WO 2018/150955 | A1 | 8/2018 |

*Primary Examiner* — Adil A. Siddiqui
(74) *Attorney, Agent, or Firm* — Birch, Stewart, Kolasch & Birch, LLP

(57) ABSTRACT

This hot-rolled steel sheet has a predetermined chemical composition, in a microstructure at a ¼ position of a sheet thickness in a sheet thickness direction from a surface, a primary phase is bainite, a secondary phase is martensite or a martensite-austenite mixed phase, an average grain size of the secondary phase is 1.5 μm or less, an average grain size of particles having grain diameters that are largest 10% or less out of all particles in the secondary phase is 2.5 μm or less, a pole density in a (110)<112> orientation is 3.0 or less, and, in a microstructure from the surface to a 1/16 position of the sheet thickness in the sheet thickness direction from the surface, a pole density in a (110)<1-11> orientation is 3.0 or less.

4 Claims, No Drawings

HOT-ROLLED STEEL SHEET

TECHNICAL FIELD OF THE INVENTION

The present invention relates to a hot-rolled steel sheet. Specifically, the present invention relates to a high-strength hot-rolled steel sheet having excellent formability and low temperature toughness.

Priority is claimed on Japanese Patent Application No. 2019-222161, filed in Japan on Dec. 9, 2019, the content of which is incorporated herein by reference.

BACKGROUND ART

High-strengthening of steel sheets is underway in order to ensure the collision safety of automobiles and reduce environmental loads. Since the high-strengthening of steel sheets degrades formability, there is a demand for improvement in formability in high-strength (preferably 980 MPa class) steel sheets. Generally, ductility, hole expansibility, and bendability are used as indexes of formability, but these characteristics are in a trade-off relationship, and there is a demand for a steel sheet being excellent in terms of ductility, hole expansibility, and bendability.

In addition, at the time of the press forming of complicated component shapes of underbody components or the like, steel sheets need to be particularly excellent in terms of ductility and hole expansibility. Furthermore, in order to secure the impact characteristics, there is a case where not only the high-strengthening of steel sheets but also excellent low temperature toughness are required.

Patent Document 1 discloses a high-strength hot-rolled steel sheet having a structure in which 85% or more of bainite by an area ratio is included as a primary phase, 15% or less of martensite or a martensite-austenite mixed phase by an area ratio is included as a secondary phase, a remainder includes ferrite, an average grain size of the secondary phase is 3.0 μm or less, furthermore, an average aspect ratio of prior austenite grains is 1.3 or more and 5.0 or less, and an area ratio of recrystallized prior austenite grains to unrecrystallized prior austenite grains is 15% or less, a precipitate having a diameter of less than 20 nm that is precipitated in a hot-rolled steel sheet is 0.10% or less by mass %, and a tensile strength TS is 980 MPa or more.

Patent Document 2 discloses a high-strength hot-rolled steel sheet including more than 90% of bainite by an area ratio as a primary phase or further including a total of less than 10% of one or more of ferrite, martensite, and residual austenite as a secondary phase, in which an average grain size of the bainite is 2.5 μm or less, intervals of Fe-based carbide grains precipitated in bainitic ferrite grains in the bainite is 600 nm or less, and a tensile strength TS is 980 MPa or more.

Patent Document 3 describes a high-strength hot-rolled steel sheet having a structure in which more than 92% of bainite by volume percentage is included, an average interval of bainite laths is 0.60 μm or less, and a number ratio of Fe-based carbide grains precipitated in grains among all Fe-based carbide grains is 10% or more, the high-strength hot-rolled steel sheet being excellent in terms of mass production punching properties.

Patent Document 4 discloses a high-strength thin steel sheet having excellent formability in which Mn microsegregation in a range of ⅛ t to ⅜ t of a sheet thickness satisfies the expression (1) ($0.10 \geq \sigma/Mn$), and 3% or more of residual austenite having an average carbon content of 0.9% or more is contained in a structure.

PRIOR ART DOCUMENT

Patent Document

[Patent Document 1] PCT International Publication No. WO 2017/017933

[Patent Document 2] PCT International Publication No. WO 2015/129199

[Patent Document 3] Japanese Unexamined Patent Application, First Publication No. 2014-205888

[Patent Document 4] Japanese Unexamined Patent Application, First Publication No. 2007-70660

DISCLOSURE OF THE INVENTION

Problems to be Solved by the Invention

In Patent Document 1, bendability is not taken into account. The present inventors found that, in the high-strength hot-rolled steel sheet disclosed in Patent Document 1, there is a case where excellent bendability cannot be obtained and there is a need to further improve the hole expansibility. Furthermore, the present inventors found that, in the high-strength hot-rolled steel sheet disclosed in Patent Document 1, there is a case where excellent low temperature toughness cannot be obtained.

In Patent Document 2, hole expansibility and bendability are not taken into account. The present inventors found that, in the high-strength hot-rolled steel sheet disclosed in Patent Document 2, there is a case where excellent hole expansibility and bendability cannot be obtained.

In Patent Document 3, since the total of martensite and residual austenite is set to less than 1% in order to ensure mass production punching properties, a sufficient strength cannot be obtained.

In Patent Document 4, air cooling is performed in the cooling after the hot rolling to ensure 3% or more of residual austenite. The steel sheet described in Patent Document 4 is a so-called TRIP steel sheet. The present inventors found that, in the steel sheet described in Patent Document 4, there is a need to further enhance the strength and the hole expansibility.

In view of the above-described circumstances, an object of the present invention is to provide a hot-rolled steel sheet being excellent in terms of strength, ductility, bendability, hole expansibility and low temperature toughness.

Means for Solving the Problem

As a result of studies by the present inventors in order for solving the above-described problems, the present inventors obtained the following findings (a) to (h).

(a) When the microstructure is made to include a single phase, the difference in hardness between structures is reduced, and it is possible to suppress the formation of voids in structural interfaces, and thus the hole expansibility of hot-rolled steel sheets can be improved.

(b) When the microstructure is made to include a bainite single phase, a high strength (preferably, a strength of 980 MPa or more) cannot be obtained. Therefore, a desired amount of a hard phase (martensite or martensite-austenite mixed phase) is included, whereby a desired strength can be obtained while ensuring the hole expansibility of hot-rolled steel sheets.

(c) When the average grain size of particles having grain diameters that are the largest 10% or less out of all particles in the hard phase, the hole expansibility of hot-rolled steel sheets can be further improved.

(d) When the pole density in a (110)<112> orientation is set to 3.0 or less, it is possible to reduce the anisotropy and to further improve the hole expansibility of hot-rolled steel sheets.

(e) When bainite is included as a primary phase (90% or more), it is possible to obtain high ductility (preferably a total elongation of 13.0% or more) and to obtain a desired ductility.

(f) In order to improve the low temperature toughness, there is a need to suppress embrittlement by precipitation hardening, and, in particular, it is effective for improving the low temperature toughness to suppress the precipitation of an MC carbide (particularly TiC) during cooling after hot rolling and to increase the average interval of MC carbide grains having a diameter of 20 nm or less. When the average cooling rate in cooling after hot rolling is set to be fast, the precipitation of an MC carbide (particularly TiC) is suppressed, whereby it is possible to increase the average interval of MC carbide grains having a diameter of 20 nm or less and to improve the low temperature toughness of hot-rolled steel sheets.

(g) The bendability of hot-rolled steel sheets can be further improved by controlling the texture in a surface layer (from the surface to a 1/16 position of the sheet thickness in the sheet thickness direction from the surface).

(h) In order to obtain the above-described microstructure, particularly, it is effective to control cooling conditions after hot rolling and cooling conditions after coiling into a coil shape in a complex and indivisible manner.

The gist of the present invention made based on the above-described findings is as follows.

[1] A hot-rolled steel sheet according to one aspect of the present invention contains, as a chemical composition, by mass %:

C: 0.040% to 0.150%,
Si: 0.50% to 1.50%,
Mn: 1.00% to 2.50%,
P: 0.100% or less,
S: 0.010% or less,
Al: 0.01% to 0.10%,
N: 0.0100% or less,
Ti: 0.005% to 0.150%,
B: 0.0005% to 0.0050%,
Cr: 0.10% to 1.00%,
Nb: 0% to 0.06%,
V: 0% to 0.50%.
Mo: 0% to 0.50%,
Cu: 0% to 0.50%,
Ni: 0% to 0.50%,
Sb: 0% to 0.020%,
Ca: 0% to 0.010%,
REM: 0% to 0.010%,
Mg: 0% to 0.010%, and
a remainder including iron and impurities, in a microstructure at a 1/4 position of a sheet thickness in a sheet thickness direction from a surface, by area ratios, a primary phase is 90.0% to 98.0% of bainite, a secondary phase is 2.0% to 10.0% of martensite or a martensite-austenite mixed phase, an average grain size of the secondary phase is 1.5 μm or less, an average grain size of particles having grain diameters that are largest 10% or less out of all particles in the secondary phase is 2.5 μm or less, a pole density in a (110)<112> orientation is 3.0 or less, and in a microstructure from the surface to a 1/16 position of the sheet thickness in the sheet thickness direction from the surface, a pole density in a (110)<1-11> orientation is 3.0 or less.

(2) The hot-rolled steel sheet according to (1) described above, in the microstructure at the 1/4 position of the sheet thickness in the sheet thickness direction from the surface, an average interval between MC carbide grains having a diameter of 20 nm or less may be 50 nm or more.

(3) The hot-rolled steel sheet according to (1) or (2) described above may contain, as the chemical composition, by mass %, one or more selected from the group consisting of:

Nb: 0.005% to 0.06%,
V: 0.05% to 0.50%,
Mo: 0.05% to 0.50%,
Cu: 0.01% to 0.50%,
Ni: 0.01% to 0.50%,
Sb: 0.0002% to 0.020%,
Ca: 0.0002% to 0.010%,
REM: 0.0002% to 0.010%, and
Mg: 0.0002% to 0.010%.

Effects of the Invention

According to the aspect of the present invention, it is possible to provide a hot-rolled steel sheet being excellent in terms of strength, ductility, bendability, hole expansibility, and low temperature toughness.

EMBODIMENTS OF THE INVENTION

The chemical composition and microstructure of a hot-rolled steel sheet (hereinafter, simply referred to as the steel sheet in some cases) according to the present embodiment will be specifically described below. However, the present invention is not limited only to a configuration disclosed in the present embodiment and can be modified in a variety of manners within the scope of the gist of the present invention.

Numerical limiting ranges expressed below using "to" include the lower limit and the upper limit in the ranges. Numerical values expressed with 'more than' and 'less than' are not included in numerical ranges. Regarding the chemical composition, "%" indicates "mass %" in all cases.

The hot-rolled steel sheet according to the present embodiment contains, in a chemical composition, by mass %, C: 0.040% to 0.150%, Si: 0.50% to 1.50%, Mn: 1.00% to 2.50%, P: 0.100% or less, S: 0.010% or less, Al: 0.01% to 0.10%, N: 0.0100% or less, Ti: 0.005% to 0.150%, B: 0.0005% to 0.0050%, Cr: 0.10% to 1.00%, and a remainder: iron and impurities. Hereinafter, each element will be described.

C: 0.040% to 0.150%

C is an element that accelerates the formation of bainite by improving the strength of the hot-rolled steel sheet and improving the hardenability. In order to obtain this effect, the C content is set to 0.040% or more. The C content is preferably 0.050% or more or 0.060% or more.

On the other hand, when the C content exceeds 0.150%, it becomes difficult to control the formation of bainite, a large amount of martensite or a martensite-austenite mixed phase is formed, and both or any one of the ductility and hole expansibility of the hot-rolled steel sheet deteriorates. Therefore, the C content is set to 0.150% or less. The C content is preferably 0.140% or less, 0.120% or less, or 0.100% or less.

Si: 0.50% to 1.50%

Si is an element that contributes to solid solution strengthening and is an element that contributes to improving the strength of the hot-rolled steel sheet. In addition, Si is an element that suppresses the formation of a carbide in steel. When the formation of a carbide during bainitic transformation is suppressed, fine martensite or a martensite-austenite mixed phase is formed in the lath interface of the bainite. Since the martensite or the martensite-austenite mixed phase present in the bainite is fine, there is no case where the hole expansibility of the hot-rolled steel sheet is degraded. In order to obtain the above-described effect of the containing of Si, the Si content is set to 0.50% or more. The Si content is preferably 0.55% or more, 0.60% or more, or 0.65% or more.

On the other hand, Si is also an element that degrades toughness, and, when the Si content exceeds 1.50%, the toughness of the hot-rolled steel sheet deteriorates. Therefore, the Si content is set to 1.50% or less. The Si content is preferably 1.30% or less, 1.20% or less, or 1.00% or less.

Mn: 1.00% to 2.50%

Mn forms a solid solution in steel to contribute to an increase in the strength of the hot-rolled steel sheet, accelerates the formation of bainite by improving hardenability, and improves the hole expansibility of the hot-rolled steel sheet. In order to obtain such an effect, the Mn content is set to 1.00% or more. The Mn content is preferably 1.30% or more or 1.50% or more.

On the other hand, when the Mn content exceeds 2.50%, the formation control of bainite becomes difficult and martensite or a martensite-austenite mixed phase increases to degrade both or any one of the ductility and hole expansibility of the hot-rolled steel sheet. Therefore, the Mn content is set to 2.50% or less. The Mn content is preferably 2.00% or less or 1.95% or less.

P: 0.100% or Less

P is an element that forms a solid solution in steel to contribute to an increase in the strength of the hot-rolled steel sheet. However, P is also an element that is segregated at grain boundaries, particularly, prior austenite grain boundaries, and promotes intergranular fracture due to the grain boundary segregation, thereby degrading the ductility, bendability, and hole expansibility of the hot-rolled steel sheet. The P content is preferably set to be extremely low, but up to 0.100% of P can be allowed to be contained. Therefore, the P content is set to 0.100% or less. The P content is preferably 0.090% or less or 0.080% or less.

The P content is preferably set to 0%, but reduction in the P content to less than 0.0001% increases the manufacturing cost, and thus the P content may be set to 0.0001% or more. The P content is preferably 0.001% or more or 0.010% or more.

S: 0.010% or Less

S is an element that adversely affects weldability and manufacturability during casting and during hot rolling. S bonds to Mn to form coarse MnS. This MnS degrades the bendability and hole expansibility of the hot-rolled steel sheet and promotes the occurrence of delayed fracture. The S content is preferably set to be extremely low, but up to 0.010% of S can be allowed to be contained. Therefore, the S content is set to 0.010% or less. The S content is preferably 0.008% or less or 0.007% or less.

The S content is preferably set to 0%, but reduction in the S content to less than 0.0001% increases the manufacturing cost, which is economically disadvantageous, and thus the S content may be set to 0.0001% or more. The S content is preferably 0.001% or more.

Al: 0.01% to 0.10%

Al is an element that acts as a deoxidizing agent and is effective for improving the cleanliness of steel. In order to obtain this effect, the Al content is set to 0.01% or more. The Al content is preferably 0.02% or more.

On the other hand, when Al is excessively contained, an increase in an oxide-based inclusion is caused, and the hole expansibility of the hot-rolled steel sheet deteriorates. Therefore, the Al content is set to 0.10% or less. The Al content is preferably 0.08% or less or 0.06% or less.

N: 0.0100% or Less

N is an element that forms a coarse nitride in steel. This nitride degrades the bendability and hole expansibility of the hot-rolled steel sheet and also degrades the delayed fracture resistance property. Therefore, the N content is set to 0.0100% or less. The N content is preferably 0.0080% or less, 0.0060% or less, or 0.0050% or less.

When the N content is reduced to less than 0.0001%, a significant increase in the manufacturing cost is caused, and thus the N content may be set to 0.0001% or more. The N content is preferably 0.0005% or more and 0.0010% or more.

Ti: 0.005% to 0.150%

Ti is an element that forms a nitride in an austenite high-temperature region (a high temperature region in the austenite region and a higher temperature region than the austenite region (casting stage)). When Ti is made to be contained, precipitation of BN is suppressed, and B is in a solid solution state, whereby hardenability required for the formation of bainite can be obtained. As a result, the strength and hole expansibility of the hot-rolled steel sheet can be improved. In addition, Ti forms a carbide in steel during hot rolling to suppress recrystallization of prior austenite grains. In order to obtain these effects, the Ti content is set to 0.005% or more. The Ti content is preferably 0.020% or more, 0.030% or more, 0.050% or more, or 0.080% or more.

On the other hand, when the Ti content exceeds 0.150%, prior austenite grains are less likely to recrystallize, and a rolled texture develops, whereby the hole expansibility of the hot-rolled steel sheet deteriorates. Therefore, the Ti content is set to 0.150% or less. The Ti content is preferably 0.120% or less.

B: 0.0005% to 0.0050%

B is an element that is segregated at the prior austenite grain boundaries, suppresses the formation and growth of ferrite, and contributes to improvement in the strength and hole expansibility of the hot-rolled steel sheet. In order to obtain these effects, the B content is set to 0.0005% or more. The B content is preferably 0.0007% or more or 0.0010% or more.

On the other hand, even when more than 0.0050% of B is made to be contained, the above-described effects are saturated. Therefore, the B content is set to 0.0050% or less. The B content is preferably 0.0030% or less and 0.0025% or less.

Cr: 0.10% to 1.00%

Cr is an element that forms a carbide in steel to contribute to the high-strengthening of the hot-rolled steel sheet, accelerates the formation of bainite by improvement in hardenability, and promotes the precipitation of a Fe-based carbide in bainite grains. In order to obtain these effects, the Cr content is set to 0.10% or more. The Cr content is preferably 0.30% or more, 0.40% or more, or 0.50% or more.

On the other hand, when the Cr content exceeds 1.00%, martensite or a martensite-austenite mixed phase is likely to be formed, and both or any one of the hole expansibility and ductility of the hot-rolled steel sheet deteriorates. Therefore, the Cr content is set to 1.00% or less. The Cr content is preferably 0.80% or less and 0.70% or less.

The remainder of the chemical composition of the hot-rolled steel sheet according to the present embodiment may be Fe and impurities. In the present embodiment, the impurities mean substances that are incorporated from ore as a raw material, a scrap, manufacturing environment, or the like or substances that are permitted to an extent that the characteristics of the hot-rolled steel sheet according to the present embodiment are not adversely affected.

The hot-rolled steel sheet according to the present embodiment may contain the following elements as optional elements instead of some of Fe. In a case where the following optional elements are not made to be contained, the lower limit of the content is 0%. Hereinafter, each optional element will be described in detail.

Nb: 0% to 0.06%

Nb is an element that has an effect of forming a carbide during hot rolling to suppress the recrystallization of austenite and contributes to improvement in the strength of the hot-rolled steel sheet. In order to reliably obtain this effect, the Nb content is preferably set to 0.005% or more. The Nb content is more preferably set to 0.015% or more.

On the other hand, when the Nb content exceeds 0.06%, there is a case where the recrystallization temperature of prior austenite grains becomes too high, the texture develops, and the hole expansibility of the hot-rolled steel sheet deteriorates. Therefore, the Nb content is set to 0.06% or less. The Nb content is preferably 0.04% or less.

V: 0% to 0.50%

V is an element that has an effect of forming a carbonitride during hot rolling to suppress the recrystallization of austenite and contributes to improvement in the strength of the hot-rolled steel sheet. In order to reliably obtain this effect, the V content is preferably set to 0.05% or more. The V content is more preferably set to 0.10% or more.

On the other hand, when the V content exceeds 0.50%, the recrystallization temperature of prior austenite grains becomes high, and the recrystallization temperature of austenite grains after the completion of finish rolling becomes high, whereby there is a case where the texture develops and the hole expansibility of the hot-rolled steel sheet deteriorates. Therefore, the V content is set to 0.50% or less. The V content is preferably 0.25% or less.

Mo: 0% to 0.50%

Mo is an element that accelerates the formation of bainite by improving hardenability and contributes to improvement in the strength and hole expansibility of the hot-rolled steel sheet. In order to reliably obtain this effect, the Mo content is preferably set to 0.05% or more. The Mo content is more preferably set to 0.10% or more.

On the other hand, when the Mo content exceeds 0.50% v, martensite or a martensite-austenite mixed phase is likely to be formed, and there is a case where both or any one of the ductility and hole expansibility of the hot-rolled steel sheet deteriorates. Therefore, the Mo content is set to 0.50% or less. The Mo content is preferably 0.30% or less.

Cu: 0% to 0.50%

Cu is an element that forms a solid solution in steel to contribute to an increase in the strength of the hot-rolled steel sheet. In addition, Cu is an element that accelerates the formation of bainite by improving hardenability and contributes to improvement in the strength and hole expansibility of the hot-rolled steel sheet. In order to reliably obtain these effects, the Cu content is preferably set to 0.01% or more. The Cu content is more preferably set to 0.02% or more.

On the other hand, when the Cu content exceeds 0.50%, there is a case where the surface properties of the hot-rolled steel sheet deteriorate. Therefore, the Cu content is set to 0.50% or less. The Cu content is preferably 0.20% or less.

Ni: 0% to 0.50%

Ni is an element that forms a solid solution in steel to contribute to an increase in the strength of the hot-rolled steel sheet. In addition, Ni is an element that accelerates the formation of bainite by improving hardenability and contributes to improvement in the strength and hole expansibility of the hot-rolled steel sheet. In order to reliably obtain these effects, the Ni content is preferably set to 0.01% or more. The Ni content is more preferably set to 0.02% or more.

On the other hand, when the Ni content exceeds 0.50%, martensite or a martensite-austenite mixed phase is likely to be formed, and there is a case where both or any one of the bendability and hole expansibility of the hot-rolled steel sheet deteriorates. Therefore, the Ni content is set to 0.50% or less. The Ni content is preferably 0.20% or less.

Sb: 0% to 0.020%

Sb has an effect of suppressing the nitriding of slab surfaces at a slab heating stage. When Sb is contained, precipitation of BN in slab surface layer area is suppressed. In order to reliably obtain this effect, the Sb content is preferably set to 0.0002% or more. The Sb content is more preferably set to 0.001% or more. On the other hand, even when more than 0.020% of Sb is contained, the above-described effect is saturated, and thus the Sb content is set to 0.020% or less.

Ca: 0% to 0.010%

Ca is an element that controls the shape of a sulfide-based inclusion and improves the ductility and hole expansibility of the hot-rolled steel sheet. In order to reliably obtain this effect, the Ca content is preferably set to 0.0002% or more. The Ca content is more preferably set to 0.001% or more.

On the other hand, when the Ca content exceeds 0.010%, there is a case where a surface defect of the hot-rolled steel sheet is caused and the productivity deteriorates. Therefore, the Ca content is set to 0.010% or less. The Ca content is preferably 0.008% or less.

REM: 0% to 0.010%

Similar to Ca, REM is an element that controls the shape of a sulfide-based inclusion and improves the ductility and hole expansibility of the hot-rolled steel sheet. In order to reliably obtain this effect, the REM content is preferably set to 0.0002% or more. The REM content is more preferably set to 0.001% or more.

On the other hand, when the REM content exceeds 0.010%, the cleanliness of steel deteriorates, and both or any one of the hole expansibility and bendability of the hot-rolled steel sheet deteriorates. Therefore, the REM content is set to 0.010% or less. The REM content is preferably 0.008% or less.

Here, REM refers to a total of 17 elements consisting of Sc, Y, and lanthanoid, and the REM content refers to the total of the amounts of these elements. Industrially, lanthanoids are added in a mischmetal form.

Mg: 0% to 0.010%, and

Mg is an element that enables the control of the form of a sulfide when contained in a small amount. In order to reliably obtain this effect, the Mg content is preferably set to 0.0002% or more. The Mg content is more preferably set to 0.0005% or more.

On the other hand, when the Mg content exceeds 0.010%, the cold formability is degraded due to the formation of a coarse inclusion. Therefore, the Mg content is set to 0.010% or less. The Mg content is preferably 0.008% or less.

The chemical composition of the hot-rolled steel sheet may be measured by an ordinary analytical method. For example, the chemical composition may be measured using inductively coupled plasma-atomic emission spectrometry (ICP-AES). C and S may be measured using an infrared absorption method after combustion, and N may be measured using an inert gas melting-thermal conductivity method.

Next, the microstructure of the hot-rolled steel sheet according to the present embodiment will be described.

In the hot-rolled steel sheet according to the present embodiment, in the microstructure at a ¼ position of the sheet thickness in the sheet thickness direction from the surface, by area ratios, a primary phase is 90.0% to 98.0% of bainite, a secondary phase is 2.0% to 10.0% of martensite or a martensite-austenite mixed phase, the average grain size of the secondary phase is 1.5 μm or less, the average grain size of particles having grain diameters that are largest 10% or less out of all particles in the secondary phase is 2.5 μm or less, the pole density in a (110)<112> orientation is 3.0 or less, and, in the microstructure from the surface to a 1/16 position of the sheet thickness in the sheet thickness direction from the surface, the pole density in a (110)<1-11> orientation is 3.0 or less.

In this embodiment, the reason for regulating the types of the primary phase and the secondary phase at the ¼ position of the sheet thickness in the sheet thickness direction from the surface, the average grain size of the secondary phase, and the pole density in the (110)<112> orientation is that the microstructure at this position indicates the representative microstructure of the steel sheet. In addition, the position where the microstructure is regulated is preferably the central position in the sheet width direction.

Hereinafter, each regulation will be described.

Bainite (Primary Phase): 90.0% to 98.0%

The hot-rolled steel sheet according to this embodiment includes bainite as a primary phase. The area ratio of the bainite, which is the primary phase, is 90.0% or more. In the present embodiment, the primary phase means that the area ratio is 90.0% or more.

The bainite means lath-shaped bainitic ferrite and a structure having an Fe-based carbide between bainitic ferrite grains and/or inside bainitic ferrite. Unlike polygonal ferrite, the bainitic ferrite has a lath shape and has a relatively high dislocation density inside and thus can be easily distinguished from other structures using a SEM or a TEM.

In order to achieve a high strength (preferably a tensile strength of 980 MPa or more) and enhance the hole expansibility, the hot-rolled steel sheet needs to include bainite as a primary phase. When the area ratio of the bainite is less than 90.0%, the hole expansibility significantly deteriorates due to the difference in hardness from the secondary phase. Therefore, the area ratio of the bainite is set to 90.0% or more. The area ratio of the bainite is preferably 92.0% or more or 93.0% or more.

On the other hand, when the area ratio of the bainite is more than 98.0%, there is a case where a high strength (preferably a tensile strength of 980 MPa or more) cannot be obtained, and thus the area ratio of the bainite is set to 98.0% or less. The area ratio of the bainite is preferably 96.0% or less or 95.0% or less.

Martensite or Martensite-Austenite Mixed Phase (Secondary Phase): 2.0% to 10.0%

The hot-rolled steel sheet according to the present embodiment includes martensite or a martensite-austenite mixed phase as a secondary phase. The martensite is an aggregate of lath-shaped crystal grains and means a structure in which an iron carbide has two or more elongation directions inside the grains. The martensite-austenite mixed phase is also called striped martensite (MA: Martensite-Austenite constituent) and means a structure made up of both martensite and residual austenite.

As the area ratio of the secondary phase increases, the tensile strength of the hot-rolled steel sheet can be further improved. When the area ratio of the secondary phase is less than 2.0%, a desired tensile strength cannot be obtained. Therefore, the area ratio of the secondary phase is set to 2.0% or more. The area ratio of the secondary phase is preferably 3.0% or more, 4.0% or more, or 5.0% or more. On the other hand, when the area ratio of the secondary phase is more than 10.0%, desired hole expansibility and ductility cannot be obtained. Therefore, the area ratio of the secondary phase is set to 10.0% or less. The area ratio of the secondary phase is preferably 9.0% or less, 8.0% or less, or 7.0% or less.

The hot-rolled steel sheet according to the present embodiment may include 5% or less of ferrite in addition to the bainite and the secondary phase. However, there is no need to necessarily include ferrite, and thus the area ratio of ferrite may be 0%.

Hereinafter, a method for measuring the area ratio of the microstructure will be described.

First, a test piece is collected from the hot-rolled steel sheet such that a sheet thickness cross section that intersects a rolling direction and is at a ¼ position of the sheet thickness in the sheet thickness direction from the surface (a region from a ⅛ position in the sheet thickness direction from the surface to a ⅜ position in the sheet thickness direction from the surface, that is, a region including the ⅛ position in the sheet thickness direction from the surface as a start point and the ⅜ position in the sheet thickness direction from the surface as an end point) can be observed. A cross section of the test piece is mirror-polished and corroded with a LePera etchant, and then the structure is observed using an optical microscope.

The secondary phase is made to appear as a white part by the LePera etchant, and the other structure (bainite) is stained, which makes it possible to easily distinguish both. The microstructure is binarized into the white part (bright part) and the other region, and the area ratio of the white part is calculated. For example, the microstructure is binarized into the white part and the other region using image analysis software such as Image-J, whereby it is possible to obtain the area ratio of the white part and the area ratio of the other region. Three or more observation visual fields are observed, and the area of each visual field is set to 300 μm×400 μm or more.

The area ratio of the secondary phase is obtained by calculating the average value of the area ratios of the white part measured in the plurality of visual fields. The area ratio of the bainite is obtained by calculating the average value of the area ratios of the region other than the white part measured in the plurality of visual fields.

In a case where ferrite is present in the microstructure, the ferrite is stained into white like the bainite. However, the bainite and the ferrite can be easily distinguished by observing the forms thereof. In a case where the ferrite is present, the area ratio of the bainite is obtained by subtracting the area ratio of the white part distinguished as the ferrite from the area ratio of the region other than the white part. The bainite is observed as lath-shaped crystal grains, and the ferrite is observed as massive crystal grains containing no laths therein.

Average Grain Size of Secondary Phase: 1.5 μm or Less

When the average grain size of the secondary phase becomes large, voids are likely to be formed, and the hole expansibility of the hot-rolled steel sheet deteriorates. In order to suppress the formation of voids to improve the hole expansibility, the average grain size of the secondary phase is preferably as small as possible. When the average grain size of the secondary phase is more than 1.5 μm, it is not possible to obtain a desired hole expansibility. Therefore, the average grain size of the secondary phase is set to 1.5 μm or less. The average grain size of the secondary phase is preferably 1.4 μm or less and more preferably 1.3 μm or less.

Since it is technically difficult to set the average grain size of the secondary phase to less than 0.1 μm, the average grain size of the secondary phase may be set to 0.1 μm or more.

Average Grain Size of Particles Having Grain Diameters that are Largest 10% or Less Out of all Particles in Secondary Phase: 2.5 μm or Less In a case where the average grain size of particles having grain diameters that are largest 10% or less out of all particles in the secondary phase is large, the number of starting points for the formation of voids increases, and thus the hole expansibility of the hot-rolled steel sheet deteriorates. Therefore, the average grain size of the particles having grain diameters that are largest 10% or less out of all of the particles in the secondary phase is preferably as small as possible. In order to obtain desired hole expansibility, the average grain size of the particles having grain diameters that are largest 10% or less out of all of the particles in the secondary phase is set to 2.5 μm or less. The average grain size of the particles is preferably 2.3 μm or less, more preferably 2.2 μm or less, and still more preferably 2.0 μm or less.

The lower limit of the average grain size of the particles having grain diameters that are largest 10% or less is not particularly limited, but may be set to 1.5 μm or more or 1.7 μm or more.

Hereinafter, a method for measuring the average grain size of the secondary phase and a method for measuring the average grain size of the particles having grain diameters that are largest 10% or less out of all of the particles in the secondary phase will be described.

First, a test piece is collected from the hot-rolled steel sheet such that a sheet thickness cross section that intersects a rolling direction and is at a ¼ position of the sheet thickness in the sheet thickness direction from the surface (a region from a ⅛ position in the sheet thickness direction from the surface to a ⅜ position in the sheet thickness direction from the surface, that is, a region including the ⅛ position in the sheet thickness direction from the surface as a start point and the ⅜ position in the sheet thickness direction from the surface as an end point) can be observed. Across section of the test piece is mirror-polished and corroded with a LePera etchant, and then the structure is observed using an optical microscope. A binarized image of a white part and the other region is created using image analysis software (Image-J). After that, particles are analyzed based on the binarized image, and the area of each particle is calculated. Three or more observation visual fields are observed, and the average value of the average grain sizes obtained from each visual field is calculated, thereby obtaining the average grain size of the secondary phase.

Next, at each visual field, the average grain size of the particles having grain diameters that are largest 10% or less out of all of the particles in the secondary phase is calculated, and the average value for all of the visual fields is calculated, thereby obtaining the average grain size of the particles having grain diameters that are largest 10% or less out of all of the particles in the secondary phase.

The average grain size of the particles having grain diameters that are largest 10% or less refers to, for example, in a case where the number of particles in the secondary phase observed in one visual field is 100, and the particles are numbered 1, 2, 3, . . . , 99, and 100 in order of grain diameter (small to large), the average value of the grain diameters of the $91^{st}$ to $100^{th}$ particles.

The secondary phase having an area of less than 0.5 $\mu m^2$ does not affect the hole expansibility of the hot-rolled steel sheet and is thus excluded from the measurement subjects of the above-described measurement (the measurement of the average grain size of the secondary phase and the average grain size of the particles having grain diameters that are largest 10% or less out of all of the particles in the secondary phase).

Pole Density in (110)<112> Orientation: 3.0 or Less

The pole density in the (110)<112> orientation in the microstructure at the ¼ position of the sheet thickness in the sheet thickness direction from the surface is an index for evaluating the development status of a rolled texture. As the pole density in the (110)<112> orientation develops more, that is, as the pole density in the (110)<112> orientation increases, the anisotropy of the structure increases, and the hole expansibility of the hot-rolled steel sheet deteriorates more. When the pole density in the (110)<112> orientation exceeds 3.0, the hole expansibility deteriorates, and thus the pole density in the (110)<112> orientation is set to 3.0 or less. The pole density in the (110)<112> orientation is preferably 2.8 or less, 2.5 or less, or 2.3 or less.

As the pole density in the (110)<112> orientation decreases, the structure is more randomized, and the hole expansibility of the hot-rolled steel sheet further improves, and thus the pole density in the (110)<112> orientation is preferably as small as possible. Since the pole density in the (110)<112> orientation becomes 1.0 in a case where the hot-rolled steel sheet does not have any texture, and thus the lower limit may be set to 1.0.

Hereinafter, a method for measuring the pole density in the (110)<112> orientation will be described.

The pole density in the (110)<112> orientation can be obtained from an orientation distribution function (ODF) that displays a three-dimensional texture calculated by computing, using spherical harmonics, an orientation data measured by an electron backscattering diffraction (EBSD) method using a device in which a scanning electron microscope and an EBSD analyzer are combined and OIM Analysis (registered trademark) manufactured by AMETEK, Inc. The measurement range is set to the ¼ position of the sheet thickness in the sheet thickness direction from the surface (a region from the ⅛ position in the sheet thickness direction from the surface to the ⅜ position in the sheet thickness direction from the surface, that is, a region including the ⅛ position in the sheet thickness direction from the surface as a start point and the ⅜ position in the sheet thickness direction from the surface as an end point) and to a region that is 400 μm long in the rolling direction. The measurement pitches are preferably set such that the measurement pitches become 0.5 m/step or less.

Pole Density in (110)<1-11> Orientation in Microstructure from Surface to 1/16 Position of Sheet Thickness in Sheet Thickness Direction from Surface: 3.0 or Less The pole density in a (110)<1-11> orientation in the microstructure from the surface to a 1/16 position of the sheet thickness in the sheet thickness direction from the surface (a region including the surface as a start point and the 1/16 position of the sheet thickness in the sheet thickness direction from the surface as an end point) is an index for evaluating the development status of a shear texture in the surface layer region of the hot-rolled steel sheet. As the pole density in the (110)<1-11> orientation at this position develops more, that is, as the pole density in the (110)<1-11> orientation increases, the anisotropy of the structure increases, and the bendability of the hot-rolled steel sheet deteriorates more. When the pole density in the (110)<1-11> orientation exceeds 3.0, the bendability of the hot-rolled steel sheet deteriorates, and thus the pole density in the (110)<1-11> orientation is set to 3.0 or less. The pole density in the (110)<1-11> orientation is preferably 2.8 or less, 2.5 or less, or 2.2 or less.

As the pole density in the (110)<1-11> orientation decreases, the structure is more randomized, and the bendability of the hot-rolled steel sheet further improves, and thus the pole density in the (110)<1-11> orientation is preferably as small as possible. Since the pole density in the (110)<1-11> orientation becomes 1.0 in a case where the hot-rolled steel sheet does not have any texture, and thus the lower limit may be set to 1.0.

Hereinafter, a method for measuring the pole density in the (110)<1-11> orientation will be described.

The pole density in the (110)<1-11> orientation can be obtained from an orientation distribution function (ODF) that displays a three-dimensional texture calculated by computing, using spherical harmonics, an orientation data measured by an electron backscattering diffraction (EBSD) method using a device in which a scanning electron microscope and an EBSD analyzer are combined and OIM Analysis (registered trademark) manufactured by AMETEK, Inc. The measurement range is set to a region from the surface to the 1/16 position of the sheet thickness in the sheet thickness direction from the surface (a region including the surface as a start point and the 1/16 position of the sheet thickness in the sheet thickness direction from the surface as an end point), and a region that is 400 μm or more long in the rolling direction is evaluated. The measurement pitches are preferably set such that the measurement pitches become 0.5 μm/step or less.

In microstructure at 1/4 position of sheet thickness in sheet thickness direction from surface, average interval between MC carbide grains having diameter of 20 nm or less: 50 nm or more In the hot-rolled steel sheet according to the present embodiment, in the microstructure at the 1/4 position of the sheet thickness in the sheet thickness direction from the surface (a region from the 1/8 position in the sheet thickness direction from the surface to the 3/8 position in the sheet thickness direction from the surface, that is, a region including the 1/8 position in the sheet thickness direction from the surface as a start point and the 3/8 position in the sheet thickness direction from the surface as an end point), the average interval between MC carbide grains having a diameter of 20 nm or less may be 50 nm or more.

In the present embodiment, the MC carbide refers to metal carbides such as TiC and VC.

The average interval between MC carbide grains having a diameter of 20 nm or less can be adjusted by more strictly controlling, in particular, the cooling rate after the completion of hot rolling. Specifically, when the average cooling rate in cooling after hot rolling is set to 90° C./s or faster, it is possible to set the average interval between MC carbide grains having a diameter of 20 nm or less to 50 nm or more in the microstructure at the 1/4 position of the sheet thickness in the sheet thickness direction from the surface.

When the average interval between MC carbide grains having a diameter of 20 nm or less is set to 50 nm or more, it is possible to further improve the low temperature toughness of the hot-rolled steel sheet.

Hereinafter, a method for measuring the average interval between MC carbide grains having a diameter of 20 nm or less will be described.

First, a test piece is collected from the hot-rolled steel sheet such that the microstructure in a sheet thickness cross section that is parallel to the rolling direction of the hot-rolled steel sheet and is at a 1/4 position of the sheet thickness in the sheet thickness direction from the surface (a region from a 1/8 position in the sheet thickness direction from the surface to a 3/8 position in the sheet thickness direction from the surface) can be observed. The cross section is electrolytically etched, and 10 visual fields are photographed with a transmission electron microscope (TEM) at a magnification of 20000 times. For precipitates having a diameter of 20 nm or less in the photographed photograph, the closest distances are obtained by image analysis, and the average value thereof is calculated, thereby obtaining the average interval between MC carbide grains having a diameter of 20 nm or less.

MC carbide grains for which the diameter of the precipitate is less than 5 nm do not affect the improvement in low temperature toughness, are difficult to observe, and are thus excluded from the above-described observation subjects. In addition, the MC carbide to be observed refers to metal carbides such as TiC and VC.

Next, a preferred method for manufacturing the hot-rolled steel sheet according to the present embodiment will be described.

The preferred method for manufacturing the hot-rolled steel sheet according to the present embodiment includes the following steps.

A heating step of heating a slab having a predetermined chemical composition to 1100° C. or higher and lower than 1350° C., a hot rolling step of performing hot rolling such that the hot rolling start temperature is 1050° C. to 1200° C. and the finish rolling completion temperature is higher than 950° C. and 1050° C. or lower, a cooling step of, after the completion of the hot rolling, starting cooling within 1.0 second and performing cooling to a cooling stop temperature of 400° C. to 500° C. at an average cooling rate of 30 to 150° C./s, a coiling step of performing the cooling at the cooling stop temperature and then performing coiling in a temperature range of 400° C. to 500° C., and a coil cooling step of, after the coiling, performing cooling to a temperature range of 50° C. or lower at an average cooling rate of faster than 25° C./h and 100° C./h or slower.

Hereinafter, each step will be described in detail.

Heating Step

In the heating step, a slab having the above-described chemical composition is heated to 1100° C. or higher and lower than 1350° C. Since a coarse precipitate present in a slab stage cause cracking during rolling or deterioration of material characteristics, it is preferable to heat the steel material before hot rolling to form a solid solution of the coarse carbide. Therefore, the heating temperature is preferably set to 1100° C. or higher. The heating temperature is more preferably 1150° C. or higher. On the other hand, even when the heating temperature becomes too high, the yield decreases due to an increase in the amount of a scale generated, and thus the heating temperature is preferably set to 1350° C. or lower. The heating temperature is more preferably 1300° C. or lower.

A cast piece to be heated is preferably produced by continuous casting from the viewpoint of the production cost, but may also be produced by a different casting method (for example, an ingot-making method).

Hot Rolling Step

The temperature of the steel sheet in hot rolling affects the precipitation of a carbide or nitride of Ti and Nb in austenite. When the hot rolling start temperature is lower than 1050° C., precipitation starts before the start of hot rolling and a precipitate becomes coarse, and thus there is a case where it is not possible to control the precipitate to a desired form, and it is not possible to obtain a homogeneous slab. Therefore, the hot rolling start temperature is preferably set to 1050° C. or higher. The hot rolling start temperature is more preferably 1070° C. or higher.

On the other hand, when the hot rolling start temperature is higher than 1200° C., it becomes difficult to start the precipitation of a precipitate during hot rolling, and there is a case where it is not possible to control the precipitate to a desired form. Therefore, the hot rolling start temperature is preferably set to 1200° C. or lower. The hot rolling start temperature is more preferably 1170° C. or lower.

The finish rolling completion temperature is a factor that affects the texture of prior austenite grains. When the finish rolling completion temperature is 950° C. or lower, the texture of the prior austenite grains develops, and there is a case where the anisotropy of the steel material characteristics increases. Therefore, the finish rolling completion temperature is preferably set to higher than 950° C. The finish rolling completion temperature is more preferably 960° C. or higher.

On the other hand, when the finish rolling completion temperature is too high, the prior austenite grains become significantly coarse, and the secondary phase becomes coarse, which makes it impossible to obtain desired hole expansibility in some cases. Therefore, the finish rolling completion temperature is preferably set to 1050° C. or lower. The finish rolling completion temperature is more preferably 1020° C. or lower.

Before the hot rolling, the slab may be rough-rolled to form a rough bar and then hot-rolled.

In addition, before the finish rolling, it is usual to remove a scale formed on the surface of the steel sheet (descaling). In the present embodiment, the descaling may be performed by a normal method and may be performed such that, for example, the collision pressure of water to be sprayed becomes less than 3.0 MPa. When high-pressure descaling in which the collision pressure of water to be sprayed is 3.0 MPa or more is performed, there is a case where it is not possible to preferably control the texture in the surface layer.

In addition, in the finish rolling, the total rolling reduction of the rolling reduction in the final pass and the rolling reduction one pass before the final pass is preferably set to smaller than 30% in order to preferably control the texture.

Cooling Step

In the present embodiment, in order to obtain a desired microstructure, it is effective to control cooling conditions after the hot rolling in the cooling step and cooling conditions after the coiling into a coil shape in the coil cooling step in a complex and indivisible manner.

In the above-described hot rolling, since the rolling is performed at a relatively high temperature, the coarsening of the prior austenite grains is likely to proceed. Therefore, it is necessary to start cooling within a time after the completion of the finish rolling and suppress the coarsening of the prior austenite grains. When the time taken from the completion of the finish rolling to the start of the cooling is long, the prior austenite grains become coarse, and there is a case where it is not possible to obtain a desired average grain size of the secondary phase and a desired average grain size of the particles having grain diameters that are largest 10% or less out of all of the particles in the secondary phase. The cooling start time is preferably as early as possible, and, in the present embodiment, it is preferable to start the cooling within 1.0 second after the completion of the hot rolling. The cooling start time is more preferably 0.5 seconds or shorter and more preferably 0 seconds.

The cooling start time mentioned herein means the elapsed time from the completion of the finish rolling to the start of cooling described below (cooling with an average cooling rate of 30 to 150° C./s).

The cooling after the hot rolling is preferably performed at an average cooling rate of 30 to 150° C./s to a cooling stop temperature of 400° C. to 500° C. When the average cooling rate is too slow, there is a case where ferrite is precipitated, it becomes impossible to obtain a desired amount of bainite, and it is not possible to obtain both or any one of a desired tensile strength and desired hole expansibility. In addition, when the average cooling rate is slow, there is a case where Ti, V, Nb, and the like, which are carbide-forming elements, bond to carbon, a large amount of a precipitate is formed, and the low temperature toughness of the hot-rolled steel sheet deteriorates. Therefore, the average cooling rate of the cooling after the completion of the hot rolling is preferably set to 30° C./s or faster.

In order to further suppress the amount of the MC carbide, there is a need to increase the average cooling rate. In the present embodiment, in order to set the average interval between the MC carbide grains having a diameter of 20 nm or less to 50 nm or more in the microstructure at the ¼ position of the sheet thickness in the sheet thickness direction from the surface, the average cooling rate in the cooling after the hot rolling may be set to 90° C./s or faster.

On the other hand, when the average cooling rate after the completion of the hot rolling is too fast, the surface temperature becomes too low, which makes martensite likely to be formed on the surface of the steel sheet and makes it impossible to obtain desired ductility and/or desired bendability in some cases. Therefore, the average cooling rate of the cooling after the completion of the hot rolling is preferably set to 150° C./s or slower. The average cooling rate is more preferably 120° C./s or slower and more preferably 100° C./s or slower.

In the present embodiment, the average cooling rate is defined as a value obtained by dividing a temperature difference between the start point and the end point of a set range by the elapsed time from the start point to the end point.

When the cooling stop temperature is outside a temperature range of 400° C. to 500° C., it is not possible to perform the coiling step described below in a desired temperature range. In addition, in order to obtain a desired microstructure, it is desirable not to perform air cooling in order to suppress ferritic transformation during cooling in the cooling after the hot rolling.

Coiling Step

After the cooling after the hot rolling is stopped, in order to suppress ferritic transformation to cause bainitic transformation to proceed and to control the distribution, form, and fraction of the secondary phase, coiling is preferably performed such that a coiling temperature is within a temperature range of 400° C. to 500° C. When the coiling temperature is lower than 400° C., martensitic transformation is likely to occur, which increases the area ratio of martensite and makes it impossible to obtain desired ductility in some cases. Therefore, the coiling temperature is preferably set to 400° C. or higher. The coiling temperature is more preferably 420° C. or higher.

On the other hand, when the coiling temperature is higher than 500° C., the carbide-forming elements such as Ti, Nb, and V bond to carbon and form a fine MC carbide, which degrades the low temperature toughness of the hot-rolled steel sheet in some cases. Therefore, the coiling temperature is preferably set to 500° C. or lower. The coiling temperature is more preferably 480° C. or lower.

Coil Cooling Step

The cooling rate after the coiling into a coil shape affects the microstructural fraction of the secondary phase. In the coil cooling step, carbon concentration in untransformed austenite is performed. Untransformed austenite is a structure before transformation into the secondary phase (martensite or the martensite-austenite mixed phase). When the hot-rolled steel sheet is coiled in a coil shape and then cooled at an average cooling rate of 25° C./h or slower, there is a case where the untransformed austenite decomposes and a desired amount of the secondary phase cannot be obtained. In addition, carbon concentration in untransformed austenite proceeds excessively, the hardness of the secondary phase becomes excessive, and a difference in hardness between the structures of the primary phase and the secondary phase becomes large, which degrades the hole expansibility of the hot-rolled steel sheet in some cases. Therefore, the average cooling rate is preferably set to faster than 25° C./h. The average cooling rate is more preferably 30° C./h or faster.

On the other hand, when the average cooling rate is too fast, the cooling rate differs between the inside and the outside of the coil, and there is a case where it is not possible to uniformly cool the coil. Therefore, the average cooling rate is preferably set to 100° C./h or slower. The average cooling rate is more preferably 80° C./h or slower and still more preferably 60° C./h or slower.

The cooling after the coiling into a coil shape is preferably performed to a temperature range of 50° C. or lower at the above-described average cooling rate.

EXAMPLES

Next, examples of the present invention will be described. Conditions in the examples are examples of the conditions adopted to confirm the feasibility and effect of the present invention. The present invention is not limited to these examples of the conditions. The present invention is capable of adopting a variety of conditions as long as the object of the present invention is achieved without departing from the gist of the present invention.

Steels having a chemical composition shown for Steel Nos. 1 to 42 in Tables 1 and 2 were made from melting, and slabs having a thickness of 240 to 300 mm were manufactured by continuous casting. Hot-rolled steel sheets were obtained under manufacturing conditions shown in Tables 3 and 4 using the obtained slabs. The "average cooling rate between FT and CT" in Tables 3 and 4 indicates the average cooling rate from the start of cooling after hot rolling to coiling (stop of cooling). In addition, before finish rolling, descaling was performed by a normal method (the collision pressure of water to be sprayed was less than 3.0 MPa). Only for No. 41, descaling was performed such that the collision pressure of water to be sprayed became 3.5 MPa.

TABLE 1

| Steel | Chemical composition, mass % (remainder: Fe and impurities) | | | | | | | | | | | |
|---|---|---|---|---|---|---|---|---|---|---|---|---|
| No. | C | Si | Mn | P | S | Al | N | Ti | B | Cr | Nb | V |
| 1 | 0.082 | 1.30 | 1.92 | 0.082 | 0.003 | 0.03 | 0.0023 | 0.110 | 0.0017 | 0.61 | | |
| 2 | 0.071 | 0.81 | 1.65 | 0.048 | 0.009 | 0.03 | 0.0032 | 0.110 | 0.0012 | 0.63 | 0.02 | |
| 3 | 0.069 | 0.71 | 1.75 | 0.059 | 0.008 | 0.03 | 0.0039 | 0.110 | 0.0014 | 0.68 | | 0.05 |
| 4 | 0.065 | 0.77 | 1.82 | 0.055 | 0.007 | 0.03 | 0.0024 | 0.110 | 0.0015 | 0.98 | 0.02 | 0.05 |
| 5 | 0.091 | 0.62 | 1.23 | 0.051 | 0.002 | 0.03 | 0.0034 | 0.110 | 0.0014 | 0.66 | | |
| 6 | 0.097 | 0.67 | 1.79 | 0.048 | 0.002 | 0.03 | 0.0036 | 0.120 | 0.0016 | 0.52 | | |
| 7 | 0.112 | 1.11 | 1.65 | 0.063 | 0.008 | 0.03 | 0.0015 | 0.042 | 0.0017 | 0.40 | | |
| 8 | 0.142 | 1.19 | 2.30 | 0.034 | 0.002 | 0.03 | 0.0027 | 0.022 | 0.0021 | 0.71 | | |
| 9 | 0.137 | 0.75 | 1.80 | 0.066 | 0.007 | 0.03 | 0.0039 | 0.032 | 0.0023 | 0.62 | | |
| 10 | 0.144 | 0.70 | 2.31 | 0.063 | 0.010 | 0.03 | 0.0029 | 0.023 | 0.0020 | 0.30 | | |
| 11 | 0.080 | 0.75 | 1.80 | 0.081 | 0.001 | 0.03 | 0.0040 | 0.071 | 0.0012 | 0.62 | 0.02 | |
| 12 | 0.061 | 0.75 | 1.70 | 0.060 | 0.009 | 0.03 | 0.0025 | 0.087 | 0.0013 | 0.62 | | 0.05 |
| 13 | 0.077 | 0.81 | 1.72 | 0.025 | 0.009 | 0.03 | 0.0019 | 0.098 | 0.0021 | 0.65 | | |
| 14 | 0.071 | 0.71 | 1.85 | 0.078 | 0.003 | 0.03 | 0.0034 | 0.112 | 0.0015 | 0.58 | | |
| 15 | 0.067 | 0.75 | 1.90 | 0.063 | 0.006 | 0.03 | 0.0022 | 0.127 | 0.0025 | 0.62 | | |
| 16 | 0.064 | 0.75 | 1.70 | 0.065 | 0.004 | 0.03 | 0.0036 | 0.110 | 0.0015 | 0.72 | 0.02 | |
| 17 | 0.064 | 0.75 | 1.70 | 0.038 | 0.009 | 0.03 | 0.0019 | 0.110 | 0.0015 | 0.71 | 0.02 | |
| 18 | 0.160 | 0.75 | 1.70 | 0.027 | 0.002 | 0.03 | 0.0017 | 0.110 | 0.0015 | 0.62 | | |
| 19 | 0.035 | 0.75 | 1.70 | 0.094 | 0.004 | 0.03 | 0.0022 | 0.110 | 0.0015 | 0.62 | | |
| 20 | 0.110 | 0.20 | 1.48 | 0.054 | 0.008 | 0.03 | 0.0034 | 0.053 | 0.0014 | 0.88 | | |

TABLE 1-continued

| Steel No. | Chemical composition, mass % (remainder: Fe and impurities) Mo | Cu | Ni | Sb | Ca | REM | Mg | Note: |
|---|---|---|---|---|---|---|---|---|
| 1 | | | | | | | | Present Invention Steel |
| 2 | | | | | | | | Present Invention Steel |
| 3 | | | | | | | | Present Invention Steel |
| 4 | | | | | | | | Present Invention Steel |
| 5 | 0.10 | | | | | | | Present Invention Steel |
| 6 | | 0.10 | 0.05 | | | | | Present Invention Steel |
| 7 | | | | 0.008 | | | | Present Invention Steel |
| 8 | | | | | 0.002 | | | Present Invention Steel |
| 9 | | | | | | 0.004 | | Present Invention Steel |
| 10 | | | | | | | 0.003 | Present Invention Steel |
| 11 | 0.10 | | | | | | | Present Invention Steel |
| 12 | 0.10 | | 0.10 | | | | | Present Invention Steel |
| 13 | | | | | | | | Present Invention Steel |
| 14 | | | | | | | | Present Invention Steel |
| 15 | | | | | | | | Present Invention Steel |
| 16 | | | | | | | | Present Invention Steel |
| 17 | 0.10 | | | | | | | Present Invention Steel |
| 18 | | | | | | | | Comparative Steel |
| 19 | | | | | | | | Comparative Steel |
| 20 | | | | | | | | Comparative Steel |

Underlines indicate that values are outside the scope of the present invention.

TABLE 2

| Steel No. | Chemical composition, mass % (remainder: Fe and impurities) C | Si | Mn | P | S | Al | N | Ti | B | Cr | Nb | V | Mo | Cu | Ni | Sb | Ca | REM | Mg | Note |
|---|---|---|---|---|---|---|---|---|---|---|---|---|---|---|---|---|---|---|---|---|
| 21 | 0.095 | 1.70 | 1.73 | 0.023 | 0.002 | 0.03 | 0.0037 | 0.115 | 0.0005 | 0.46 | | | | | | | | | | Comparative Steel |
| 22 | 0.092 | 0.53 | 0.80 | 0.058 | 0.004 | 0.03 | 0.0030 | 0.096 | 0.0042 | 0.90 | | | | | | | | | | Comparative Steel |
| 23 | 0 065 | 1.09 | 2.60 | 0.055 | 0.002 | 0.03 | 0.0021 | 0.145 | 0.0037 | 0 30 | | | | | | | | | | Comparative Steel |
| 24 | 0.092 | 0.52 | 1.57 | 0.074 | 0.003 | 0.03 | 0.0021 | 0.000 | 0.0050 | 0.99 | | | | | | | | | | Comparative Steel |
| 25 | 0.103 | 1.49 | 2.13 | 0.028 | 0.002 | 0.03 | 0.0038 | 0.200 | 0.0033 | 0.55 | | | | | | | | | | Comparative Steel |
| 26 | 0.061 | 0.73 | 1.50 | 0.021 | 0.007 | 0.03 | 0.0032 | 0.073 | 0.0000 | 0.25 | | | | | | | | | | Comparative Steel |
| 27 | 0.040 | 0.60 | 2.40 | 0.076 | 0.009 | 0.03 | 0.0027 | 0.107 | 0.0021 | 0.05 | | | | | | | | | | Comparative Steel |
| 28 | 0.109 | 1.40 | 1.97 | 0.051 | 0.002 | 0.03 | 0.0032 | 0.140 | 0.0018 | 1.20 | | | | | | | | | | Comparative Steel |
| 29 | 0.100 | 1.46 | 2.38 | 0.029 | 0.007 | 0.03 | 0.0016 | 0.097 | 0.0031 | 0.16 | | | | | | | | | | Present Invention Steel |
| 30 | 0.103 | 1.45 | 1.19 | 0.045 | 0.005 | 0.03 | 0.0026 | 0.059 | 0.0021 | 0.98 | | | | | | | | | | Present Invention Steel |
| 31 | 0.041 | 0.61 | 1.82 | 0.085 | 0.003 | 0.03 | 0.0015 | 0.023 | 0.0016 | 0.63 | | | | | | | | | | Present Invention Steel |
| 32 | 0.045 | 0.63 | 1.92 | 0.036 | 0.009 | 0.03 | 0.0024 | 0.04.2 | 0.0018 | 0.61 | | | | | | | | | | Present Invention Steel |
| 33 | 0.130 | 0.54 | 1.80 | 0.066 | 0.002 | 0.03 | 0.0037 | 0.031 | 0.0013 | 0.73 | | | | | | | | | | Present Invention Steel |
| 34 | 0.055 | 0.91 | 1.73 | 0.057 | 0.010 | 0.03 | 0.0020 | 0.020 | 0.0012 | 0.33 | | | | | | | | | | Present Invention Steel |
| 35 | 0.048 | 0.81 | 1.65 | 0.084 | 0.003 | 0.03 | 0.0018 | 0.121 | 0.0019 | 0.32 | | | | | | | | | | Present Invention Steel |
| 36 | 0.071 | 0.52 | 1.84 | 0.063 | 0.002 | 0.03 | 0.0026 | 0.101 | 0.0023 | 0.67 | | | | | | | | | | Present Invention Steel |
| 37 | 0.082 | 0.56 | 1.82 | 0.065 | 0.005 | 0.03 | 0.0025 | 0.091 | 0.0021 | 0.27 | | | | | | | | | | Present Invention Steel |

TABLE 2-continued

| Steel No. | Chemical composition, mass % (remainder: Fe and impurities) C | Si | Mn | P | S | Al | N | Ti | B | Cr | Nb | V | Mo | Cu | Ni | Sb | Ca | REM | Mg | Note |
|---|---|---|---|---|---|---|---|---|---|---|---|---|---|---|---|---|---|---|---|---|
| 38 | 0.091 | 0.78 | 1.54 | 0.035 | 0.002 | 0.03 | 0.0024 | 0.076 | 0.0017 | 0.91 | | | | | | | | | | Present Invention Steel |
| 39 | 0.063 | 0.99 | 2.12 | 0.098 | 0.005 | 0.03 | 0.0029 | 0.081 | 0.0023 | 0.87 | | | | | | | | | | Present Invention Steel |
| 40 | 0.067 | 0.88 | 2.23 | 0.061 | 0.001 | 0.03 | 0.0031 | 0.081 | 0.0013 | 0.43 | | | | | | | | | | Present Invention Steel |
| 41 | 0.071 | 0.71 | 1.82 | 0.051 | 0.002 | 0.03 | 0.0036 | 0.042 | 0.0021 | 0.71 | | | | | | | | | | Present Invention Steel |
| 42 | 0.055 | 1.20 | 1.85 | 0.007 | 0.005 | 0.03 | 0.0021 | 0.120 | 0.0015 | 0.65 | | | | | | | | | | Present Invention Steel |

Underlines indicate that values are outside the scope of the present invention.

20

TABLE 3

| Test No. | Steel No. | Heating temperature ° C. | Rolling start temperature ° C. | Finish rolling completion temperature ° C. | Cooling start time Seconds | Average cooling rate between FT and CT ° C./sec | Coiling temperature ° C. | Coil cooling rate ° C./hour | Note |
|---|---|---|---|---|---|---|---|---|---|
| 1 | 1 | 1264 | 1137 | 955 | 0.6 | 61 | 481 | 33 | Present Invention Example |
| 2 | 2 | 1295 | 1113 | 965 | 0.7 | 80 | 421 | 37 | Present Invention Example |
| 3 | 3 | 1250 | 1186 | 962 | 0.8 | 77 | 432 | 28 | Present Invention Example |
| 4 | 4 | 1287 | 1108 | 971 | 0.6 | 56 | 441 | 36 | Present Invention Example |
| 5 | 5 | 1285 | 1130 | 983 | 0.5 | 59 | 451 | 35 | Present Invention Example |
| 6 | 6 | 1277 | 1160 | 985 | 0.7 | 57 | 462 | 33 | Present Invention Example |
| 7 | 7 | 1264 | 1122 | 988 | 0.6 | 53 | 471 | 31 | Present Invention Example |
| 8 | 8 | 1291 | 1186 | 992 | 0.7 | 61 | 489 | 38 | Present Invention Example |
| 9 | 9 | 1253 | 1101 | 972 | 0.8 | 46 | 495 | 32 | Present Invention Example |
| 10 | 10 | 1292 | 1186 | 981 | 0.9 | 76 | 435 | 36 | Present Invention Example |
| 11 | 11 | 1300 | 1133 | 981 | 0.1 | 81 | 475 | 31 | Present Invention Example |
| 12 | 12 | 1288 | 1104 | 999 | 0.1 | 83 | 422 | 32 | Present Invention Example |
| 13 | 13 | 1279 | 1188 | 982 | 0.2 | 91 | 432 | 34 | Present Invention Example |
| 14 | 14 | 1287 | 1143 | 975 | 0.1 | 102 | 441 | 31 | Present Invention Example |
| 15 | 15 | 1273 | 1164 | 961 | 0.1 | 122 | 459 | 32 | Present Invention Example |
| 16 | 16 | 1265 | 1176 | 965 | 0.2 | 111 | 427 | 33 | Present Invention Example |
| 17 | 17 | 1275 | 1136 | 981 | 0.1 | 95 | 479 | 31 | Present Invention Example |
| 18 | 18 | 1275 | 1166 | 972 | 0.4 | 98 | 405 | 29 | Comparative Example |
| 19 | 12 | 1261 | 1129 | 972 | 0.2 | 98 | 450 | 28 | Comparative Example |
| 20 | 20 | 1295 | 1157 | 972 | 0.7 | 95 | 463 | 35 | Comparative Example |

Underlines indicate that values are outside the scope of the present invention.

TABLE 4

| Test No. | Steel No. | Heating temperature ° C. | Rolling start temperature ° C. | Finish rolling completion temperature ° C. | Cooling start time Seconds | Average cooling rate between FT and CT ° C./sec | Coiling temperature ° C. | Coil cooling rate ° C./hour | Note |
|---|---|---|---|---|---|---|---|---|---|
| 21 | 21 | 1287 | 1159 | 972 | 0.4 | 99 | 485 | 29 | Comparative Example |
| 22 | 22 | 1273 | 1143 | 972 | 0.7 | 101 | 426 | 31 | Comparative Example |
| 23 | 23 | 1267 | 1102 | 972 | 0.7 | 101 | 437 | 33 | Comparative Example |
| 24 | 24 | 1290 | 1101 | 951 | 0.9 | 99 | 451 | 41 | Comparative Example |
| 25 | 25 | 1264 | 1139 | 961 | 0.9 | 101 | 419 | 50 | Comparative Example |
| 26 | 26 | 1286 | 1185 | 963 | 0.8 | 101 | 492 | 80 | Comparative Example |
| 27 | 27 | 1265 | 1110 | 983 | 0.8 | 99 | 434 | 95 | Comparative Example |
| 28 | 28 | 1256 | 1174 | 972 | 0.8 | 101 | 463 | 100 | Comparative Example |
| 29 | 29 | 1277 | 1100 | 870 | 0.6 | 101 | 451 | 100 | Comparative Example |
| 30 | 30 | 1287 | 1196 | 1061 | 0.3 | 99 | 442 | 77 | Comparative Example |
| 31 | 31 | 1273 | 1175 | 1030 | 1.2 | 101 | 432 | 87 | Comparative Example |
| 32 | 32 | 1271 | 1123 | 1020 | 1.6 | 101 | 441 | 35 | Comparative Example |

TABLE 4-continued

| Test No. | Steel No. | Heating temperature ° C. | Rolling start temperature ° C. | Finish rolling completion temperature ° C. | Cooling start time Seconds | Average cooling rate between FT and CT ° C./sec | Coiling temperature ° C. | Coil cooling rate ° C./hour | Note |
|---|---|---|---|---|---|---|---|---|---|
| 33 | 33 | 1278 | 1175 | 983 | 0.9 | 10 | 475 | 41 | Comparative Example |
| 34 | 34 | 1297 | 1123 | 972 | 0.5 | 160 | 494 | 55 | Comparative Example |
| 35 | 35 | 1273 | 1175 | 980 | 0.4 | 98 | 385 | 51 | Comparative Example |
| 36 | 36 | 1291 | 1123 | 951 | 0.5 | 99 | 350 | 26 | Comparative Example |
| 37 | 37 | 1282 | 1175 | 971 | 0.6 | 97 | 465 | 10 | Comparative Example |
| 38 | 38 | 1256 | 1123 | 982 | 0.8 | 102 | 426 | 20 | Comparative Example |
| 39 | 39 | 1287 | 1175 | 911 | 0.7 | 101 | 438 | 31 | Comparative Example |
| 40 | 40 | 1277 | 1123 | 982 | 0.9 | 25 | 454 | 32 | Comparative Example |
| 41 | 41 | 1287 | 1130 | 985 | 0.7 | 51 | 442 | 33 | Comparative Example |
| 42 | 42 | 1273 | 1176 | 950 | 0.4 | 83 | 451 | 73 | Comparative Example |

Underlines indicate that values are outside the scope of the present invention.

For the obtained hot-rolled steel sheets, the microstructural fraction at the ¼ position of the sheet thickness in the sheet thickness direction from the surface, the average grain size of the secondary phase, the average grain size of the particles having grain diameters that are largest 10% or less out of all of the particles in the secondary phase, the pole density in the (110)<112> orientation, the average interval between precipitates having a diameter of 20 nm or less, and the pole density in the (110)<1-11> orientation in the microstructure from the surface to the 1/16 position of the sheet thickness in the sheet thickness direction from the surface were obtained by the above-described methods. In Test Nos. 18, 33, 35, and 36, the secondary phase particles were connected, and it was not possible to measure the grain diameters as particles.

The obtained results are shown in Tables 5 and 6. In examples where the total of the area ratios of bainite and the secondary phase did not reach 100%, the remainder of the microstructure was ferrite. In addition, in Test No. 24, no precipitates having a diameter of 20 nm or less were observed.

TABLE 5

| Test No. | Steel No. | Bainite Area % | Secondary phase Area % | Average grain size of secondary phase μm | Average grain size of particles having grain diameters that are largest 10% or less μm | Pole density in (110)<112> orientation at sheet thickness ¼ position from Surface — | Pole density in (110)<1-11> orientation from surface to sheet thickness 1/16 position from surface — | Average interval between precipitates having diameter of 20 nm or less nm | Note |
|---|---|---|---|---|---|---|---|---|---|
| 1 | 1 | 97.9 | 2.1 | 1.4 | 2.0 | 2.3 | 2.2 | 45 | Present Invention Example |
| 2 | 2 | 96.8 | 22 | 1.3 | 2.0 | 1.9 | 1.8 | 42 | Present Invention Example |
| 3 | 3 | 93.9 | 6.1 | 1.4 | 2.2 | 2.3 | 2.5 | 43 | Present Invention Example |
| 4 | 4 | 91.1 | 8.9 | 1.3 | 2.2 | 1.8 | 1.8 | 38 | Present Invention Example |
| 5 | 5 | 95.4 | 4.6 | 1.4 | 2.2 | 2.2 | 2.4 | 42 | Present Invention Example |
| 6 | 6 | 91.7 | 8.3 | 1.4 | 2.1 | 2.2 | 2.3 | 45 | Present Invention Example |
| 7 | 7 | 96.4 | 3.6 | 1.4 | 2.1 | 1.8 | 1.8 | 31 | Present Invention Example |
| 8 | 8 | 90.7 | 9.3 | 1.3 | 2.4 | 2.0 | 1.9 | 35 | Present Invention Example |
| 9 | 9 | 97.1 | 2.9 | 1.4 | 2.4 | 2.1 | 1.8 | 37 | Present Invention Example |
| 10 | 10 | 98.0 | 2.0 | 1.3 | 2.0 | 2.5 | 2.2 | 46 | Present Invention Example |
| 11 | 11 | 94.7 | 5.3 | 1.3 | 2.0 | 2.1 | 2.5 | 49 | Present Invention Example |
| 12 | 12 | 94.8 | 5.2 | 1.3 | 2.1 | 2.5 | 2.2 | 45 | Present Invention Example |
| 13 | 13 | 95.8 | 4.2 | 1.3 | 2.1 | 2.1 | 1.9 | 111 | Present Invention Example |
| 14 | 14 | 91.0 | 9.0 | 1.4 | 2.1 | 1.8 | 2.1 | 152 | Present Invention Example |
| 15 | 15 | 90.9 | 9.1 | 1.3 | 2.2 | 2.1 | 2.0 | 98 | Present Invention Example |
| 16 | 16 | 94.1 | 5.9 | 1.4 | 2.0 | 2.2 | 1.9 | 85 | Present Invention Example |
| 17 | 17 | 97.8 | 2.2 | 1.4 | 2.3 | 2.4 | 1.9 | 201 | Present Invention Example |
| 18 | 18 | 12.0 | 88.0 | — | — | 2.4 | 2.2 | 35 | Comparative Example |
| 19 | 12 | 99.0 | 1.0 | 1.4 | 2.3 | 2.2 | 2.0 | 37 | Comparative Example |
| 20 | 20 | 92.0 | 8.0 | 1.4 | 2.0 | 2.3 | 2.4 | 21 | Comparative Example |

Underlines indicate that values are outside the scope of the present invention.

TABLE 6

| Test No. | Steel No. | Bainite Area % | Secondary phase Area % | Average grain size of secondary phase μm | Average grain size of particles having grain diameters that are largest 10% or less μm | Pole density in (110)<112> orientation at sheet thickness ¼ position from surface — | Pole density in (110)<I-11> orientation from surface to sheet thickness 1/16 position from surface — | Average interval between precipitates having diameter of 20 nm or less nm | Note |
|---|---|---|---|---|---|---|---|---|---|
| 21 | 21 | 95.2 | 4.8 | 1.3 | 2.2 | 2.4 | 2.0 | 22 | Comparative Example |
| 22 | 22 | 32.0 | 68.0 | 1.3 | 2.1 | 2.5 | 2.4 | 30 | Comparative Example |
| 22 | 23 | 86.9 | 13.1 | 1.4 | 2.1 | 2.2 | 1.9 | 33 | Comparative Example |
| 24 | 24 | 93.8 | 6.2 | 1.3 | 2.4 | 2.1 | 2.4 | — | Comparative Example |
| 25 | 22 | 97 8 | 2.2 | 1.4 | 2.1 | 3.4 | 4.3 | 29 | Comparative Example |
| 26 | 26 | 29.8 | 0.2 | 1.3 | 2.0 | 1.9 | 2.2 | 34 | Comparative Example |
| 27 | 27 | 83.0 | 3.1 | 1.4 | 2.3 | 1.8 | 2.1 | 23 | Comparative Example |
| 28 | 28 | 87.8 | 12.2 | 1.3 | 2.4 | 2.0 | 2.2 | 35 | Comparative Example |
| 29 | 29 | 93.4 | 6.6 | 1.4 | 2.1 | 3.1 | 4.2 | 38 | Comparative Example |
| 30 | 30 | 94.2 | 5.8 | 1.6 | 2.2 | 2.5 | 1.6 | 41 | Comparative Example |
| 21 | 31 | 93.2 | 6.8 | 1.4 | 2.6 | 1.8 | 2.5 | 49 | Comparative Example |
| 32 | 32 | 97.2 | 2.8 | 1.4 | 2.8 | 2.4 | 1.8 | 48 | Comparative Example |
| 22 | 33 | 34.2 | 6.2 | — | — | 1.8 | 2.2 | 35 | Comparative Example |
| 34 | 34 | 89.9 | 10.1 | 1.3 | 2.0 | 2.8 | 3.1 | 36 | Comparative Example |
| 25 | 35 | 15.0 | 85.0 | — | — | 2.2 | 2.1 | 35 | Comparative Example |
| 36 | 36 | 0.0 | 100.0 | — | — | 2.2 | 1.9 | 49 | Comparative Example |
| 37 | 37 | 98.5 | 1.5 | 1.3 | 2.3 | 2.4 | 2.1 | 48 | Comparative Example |
| 38 | 38 | 98.1 | 1.9 | 1.3 | 2.1 | 2.0 | 2.0 | 35 | Comparative Example |
| 39 | 39 | 92.3 | 7.7 | 1.3 | 2.2 | 2.5 | 3.2 | 40 | Comparative Example |
| 40 | 40 | 87.3 | 4.4 | 1.4 | 2.2 | 2.5 | 2.1 | 15 | Comparative Example |
| 41 | 41 | 91.2 | 8.8 | 1.4 | 2.0 | 1.9 | 3.5 | 38 | Comparative Example |
| 42 | 42 | 93.1 | 6.9 | 1.3 | 2.1 | 3.2 | 3.4 | 35 | Comparative Example |

Underlines indicate that values are outside the scope of the present invention.

For the obtained hot-rolled steel sheets, the tensile strengths TS, the total elongations El, the hole expansion rates λ, the limit bend radii R, and the ductile brittle, transition temperatures vTrs were obtained by the following methods.

Tensile Strength TS and Total Elongation El

The tensile strength TS and the total elongation El were obtained by performing a tensile test using a JIS No. 5 test piece in accordance with JIS Z 2241: 2011. The cross-head speed was set to 10 mm/min. Cases where the tensile strength TS was 980 MPa or more were regarded as being excellent in terms of strength and determined as pass, and cases where the tensile strength was less than 980 MPa were regarded as being poor in strength and determined as fail. Cases where the total elongation El was 13.0% or more were regarded as being excellent in terms of ductility and determined as pass, and cases where the total elongation El was less than 13.0% were regarded as being poor in ductility and determined as fail.

Hole Expansion Rate 7

The hole expansibility was evaluated with the hole expansion rate λ that was obtained by punching a circular hole with a diameter of 10 mm using a 60° conical punch under a condition where the clearance became 12.5% and performing a hole expansion test such that burrs were formed on the die side. For each test number, a hole expansion test was performed five times, and the average value thereof was calculated, thereby obtaining the hole expansion rate λ. Cases where the hole expansion rate was 60% or more were regarded as being excellent in terms of hole expansibility and determined as pass, and cases where the hole expansion rate was less than 60% were regarded as being poor in hole expansibility and determined as fail.

Limit Bend Radius R

The bendability was evaluated with the limit bend radius R that was obtained by performing a V-bending test. The limit bend radius R was obtained by performing a V-bending test using a No. 1 test piece in accordance with JIS Z 2248: 2014 such that a direction perpendicular to a rolling direction became the longitudinal direction (the bend ridge line coincided with the rolling direction).

The V-bending test was performed by setting the angle between a die and a punch to 60° and changing the tip radii of the punches in 0.1 mm increments, and the maximum value of the tip radii of the punches that could be bent without cracking was obtained. The maximum value of the tip radii of the punches that could be bent without crack was regarded as the limit bend radius R. In a case where a value (R/t) obtained by dividing the limit bend radius R by the sheet thickness t of the test piece was 1.0 or less, the bendability was regarded as being excellent, determined as pass, and expressed as "Good" in Tables 7 and 8. On the other hand, in a case where a value (R/t) obtained by dividing the limit bend radius R by the sheet thickness t of the test piece was more than 1.0, the bendability was regarded as being poor, determined as fail, and expressed as "Bad" in Tables 7 and 8.

Ductile Brittle Transition Temperature vTrs

For the ductile brittle transition temperature vTrs, a Charpy impact test was performed using a V-notch test piece having a subsize of 2.5 mm regulated in JIS Z 2242: 2018. A temperature at which the brittle fracture surface ratio became 50% was obtained, and this was regarded as the ductile brittle transition temperature vTrs. In a case where the ductile brittle transition temperature vTrs was −40° C. or lower (−40° C. was included, negative values from −40° C.), the low temperature toughness was regarded as being excellent and determined as pass, and, in a case where the ductile brittle transition temperature vTrs was higher than −40° C. (−40° C. was not included, positive values from −40° C.), the low temperature toughness was regarded as being poor and determined as fail. In addition, in a case where the ductile brittle transition temperature vTrs was −70° C. or lower, the low temperature toughness was determined as more excellent.

The above-described test results are shown in Tables 7 and 8.

TABLE 7

| Test No. | Steel No. | Tensile strength TS MPa | Total elongation El % | Hole expansion rate λ % | Bendability | Ductile brittle transition temperature vTrs ° C. | Note |
|---|---|---|---|---|---|---|---|
| 1 | 1 | 1028 | 13.2 | 63 | Good | −45 | Present Invention Example |
| 2 | 2 | 1035 | 13.1 | 69 | Good | −52 | Present Invention Example |
| 3 | 3 | 1020 | 13.1 | 69 | Good | −55 | Present Invention Example |
| 4 | 4 | 991 | 13.2 | 66 | Good | −65 | Present Invention Example |
| 5 | 5 | 1057 | 13.3 | 60 | Good | −46 | Present Invention Example |
| 6 | 6 | 1032 | 13.1 | 63 | Good | −41 | Present Invention Example |
| 7 | 7 | 1079 | 13.2 | 60 | Good | −47 | Present Invention Example |
| 8 | 8 | 1015 | 13.5 | 67 | Good | −54 | Present Invention Example |
| 9 | 9 | 1004 | 13.4 | 62 | Good | −60 | Present Invention Example |
| 10 | 10 | 1066 | 13.1 | 64 | Good | −58 | Present Invention Example |
| 11 | 11 | 1006 | 13.6 | 67 | Good | −49 | Present Invention Example |
| 12 | 12 | 987 | 13.5 | 69 | Good | −45 | Present Invention Example |
| 13 | 13 | 1034 | 13.3 | 60 | Good | −82 | Present Invention Example |
| 14 | 14 | 1021 | 13.2 | 66 | Good | −84 | Present Invention Example |
| 15 | 15 | 1012 | 13.4 | 65 | Good | −77 | Present Invention Example |
| 16 | 16 | 1015 | 13.1 | 66 | Good | −79 | Present Invention Example |
| 17 | 17 | 998 | 13.2 | 64 | Good | −81 | Present Invention Example |
| 18 | 18 | 1210 | 10.8 | 62 | Good | −53 | Comparative Example |
| 19 | 19 | 905 | 14.5 | 67 | Good | −49 | Comparative Example |
| 20 | 20 | 965 | 13.3 | 63 | Good | −42 | Comparative Example |

Underlines indicate that values are outside the scope of the present invention or are not preferable characteristics.

25

TABLE 8

| Test No. | Steel No. | Tensile strength TS MPa | Total elongation El % | Hole expansion rate λ % | Bendability | Ductile brittle transition temperature vTrs ° C. | Note |
|---|---|---|---|---|---|---|---|
| 21 | 21 | 1021 | 13.5 | 60 | Good | −30 | Comparative Example |
| 22 | 22 | 1021 | 11.5 | 61 | Good | −43 | Comparative Example |
| 23 | 23 | 1074 | 13.4 | 45 | Good | −30 | Comparative Example |
| 24 | 24 | 971 | 13.5 | 61 | Good | −47 | Comparative Example |
| 25 | 25 | 1077 | 13.2 | 55 | Bad | −20 | Comparative Example |
| 26 | 26 | 712 | 19.0 | 69 | Good | −52 | Comparative Example |
| 27 | 27 | 870 | 17.0 | 62 | Good | −64 | Comparative Example |
| 28 | 28 | 1043 | 11.2 | 67 | Good | −54 | Comparative Example |
| 29 | 29 | 1025 | 13.1 | 45 | Bad | −51 | Comparative Example |
| 30 | 30 | 1034 | 13.1 | 61 | Good | −21 | Comparative Example |
| 31 | 31 | 1025 | 13.3 | 47 | Good | −10 | Comparative Example |
| 32 | 32 | 1055 | 13.7 | 52 | Good | −5 | Comparative Example |
| 33 | 33 | 782 | 18.0 | 30 | Good | −68 | Comparative Example |
| 34 | 34 | 1031 | 12.8 | 68 | Bad | −69 | Comparative Example |
| 35 | 35 | 1020 | 10.0 | 64 | Good | −65 | Comparative Example |
| 36 | 36 | 1050 | 9.8 | 70 | Good | −48 | Comparative Example |
| 37 | 37 | 982 | 14.2 | 40 | Good | −41 | Comparative Example |
| 38 | 38 | 1049 | 13.1 | 58 | Good | −68 | Comparative Example |
| 39 | 39 | 992 | 13.1 | 61 | Bad | −69 | Comparative Example |
| 40 | 40 | 920 | 13.2 | 60 | Good | 10 | Comparative Example |
| 41 | 41 | 1022 | 13.5 | 65 | Bad | −55 | Comparative Example |
| 42 | 42 | 1002 | 14.1 | 51 | Bad | −65 | Comparative Example |

Underlines indicate that values are outside the scope of the present invention or are not preferable characteristics.

From Tables 5 to 8, it is found that the present invention examples are excellent in terms of strength, ductility, bendability, hole expansibility, and low temperature toughness. In addition, it is found that the present invention examples in which the average interval between precipitates having a diameter of 20 nm or less was 50 nm or more have more excellent low temperature toughness.

On the other hand, it is found that the comparative examples are poor in one or more characteristics of strength, ductility, bendability and hole expansibility.

INDUSTRIAL APPLICABILITY

According to the aspect of the present invention, it is possible to provide a hot-rolled steel sheet being excellent in terms of strength, ductility, bendability, hole expansibility, and low temperature toughness and a manufacturing method thereof.

The invention claimed is:

1. A hot-rolled steel sheet comprising, as a chemical composition, by mass %:

C: 0.040% to 0.150%;
Si: 0.50% to 1.50%;
Mn: 1.00% to 2.50%;
P: 0.100% or less;
S: 0.010% or less;
Al: 0.01% to 0.10%;
N: 0.0100% or less;

Ti: 0.005% to 0.150%;
B: 0.0005% to 0.0050%;
Cr: 0.10% to 1.00%;
Nb: 0% to 0.06%;
V: 0% to 0.50%;
Mo: 0% to 0.50%;
Cu: 0% to 0.50%;
Ni: 0% to 0.50%;
Sb: 0% to 0.020%;
Ca: 0% to 0.010%;
REM: 0% to 0.010%;
Mg: 0% to 0.010%; and
a remainder including iron and impurities,
wherein, in a microstructure at a ¼ position of a sheet thickness in a sheet thickness direction from a surface,
by area ratios, a primary phase is 90.0% to 98.0% of bainite, a secondary phase is 2.0% to 10.0% of martensite or a martensite-austenite mixed phase,
an average grain size of the secondary phase is 1.5 μm or less,
an average grain size of particles having grain diameters that are largest 10% or less out of all particles in the secondary phase is 2.5 μm or less,
a pole density in a (110)<112> orientation is 3.0 or less, and
in a microstructure from the surface to a 1/16 position of the sheet thickness in the sheet thickness direction from the surface, a pole density in a (110)<1-11> orientation is 3.0 or less.

2. The hot-rolled steel sheet according to claim 1,
wherein, in the microstructure at the ¼ position of the sheet thickness in the sheet thickness direction from the surface, an average interval between MC carbide grains having a diameter of 20 nm or less is 50 nm or more.

3. The hot-rolled steel sheet according to claim 1, comprising, as the chemical composition, by mass %, one or more selected from the group of:
Nb: 0.005% to 0.06%;
V: 0.05% to 0.50%;
Mo: 0.05% to 0.50%;
Cu: 0.01% to 0.50%;
Ni: 0.01% to 0.50%;
Sb: 0.0002% to 0.020%;
Ca: 0.0002% to 0.010%;
REM: 0.0002% to 0.010%; and
Mg: 0.0002% to 0.010%.

4. The hot-rolled steel sheet according to claim 2, comprising, as the chemical composition, by mass %, one or more selected from the group of:
Nb: 0.005% to 0.06%;
V: 0.05% to 0.50%;
Mo: 0.05% to 0.50%;
Cu: 0.01% to 0.50%;
Ni: 0.01% to 0.50%;
Sb: 0.0002% to 0.020%;
Ca: 0.0002% to 0.010%;
REM: 0.0002% to 0.010%; and
Mg: 0.0002% to 0.010%.

* * * * *